US011802464B2

(12) United States Patent
Williams

(10) Patent No.: US 11,802,464 B2
(45) Date of Patent: Oct. 31, 2023

(54) SEGMENTED EXPANSION CONE, METHOD AND SYSTEM

(71) Applicant: Jeffrey Williams, Cypress, TX (US)

(72) Inventor: Jeffrey Williams, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/686,699

(22) Filed: Mar. 4, 2022

(65) Prior Publication Data

US 2023/0279750 A1 Sep. 7, 2023

(51) Int. Cl.
*E21B 41/00* (2006.01)
*E21B 43/10* (2006.01)

(52) U.S. Cl.
CPC ..... *E21B 43/105* (2013.01); *E21B 41/00* (2013.01)

(58) Field of Classification Search
CPC ..... E21B 41/00; E21B 43/105; E21B 43/103
See application file for complete search history.

(56) References Cited

U.S. PATENT DOCUMENTS 3,191,677 A * 6/1965 Kinley ..... E21B 43/105 166/207
7,128,146 B2 * 10/2006 Baugh ..... E21B 43/105 72/393
8,083,001 B2 * 12/2011 Conner ..... E21B 33/1216 166/387
8,627,885 B2 1/2014 Adam et al.
9,085,967 B2 * 7/2015 Bennett ..... E21B 43/105
10,364,629 B2 * 7/2019 Jacob ..... E21B 34/14
10,914,142 B2 * 2/2021 Salinas ..... E21B 43/103
11,078,746 B2 * 8/2021 Brown ..... E21B 33/1216
2004/0168796 A1 * 9/2004 Baugh ..... E21B 43/105 166/207

(Continued)

FOREIGN PATENT DOCUMENTS

CN 102635322 A 8/2012
KR 100733146 B1 6/2007

OTHER PUBLICATIONS

Notification of Transmittal of the International Search Report and the Written Opinion; PCT/US2023/063636; Korean Intellectual Property Office; dated Jun. 30, 2023; 11 pages.

*Primary Examiner* — Daniel P Stephenson
(74) *Attorney, Agent, or Firm* — CANTOR COLBURN LLP

(57) ABSTRACT

A segmented cone expansion ring and expansion system including the ring, the ring including a plurality of segments each segment of the plurality of segments having opposing load walls, each load wall including one of a projection or a recess receptive of the projection, the projection having a neck portion and a rounded anchor portion and the recess having a rounded geometry and a set of dimensions complementary to the projection and that defines a clearance fit for the projection within the recess. A method for expanding a tubular member including introducing the expansion system a tubular member and loading the load walls of the plurality of segments of the ring while not loading the projections and recesses of the plurality of segments. A borehole system including an expansion system disposed within the borehole.

18 Claims, 5 Drawing Sheets

(56) References Cited

U.S. PATENT DOCUMENTS

| | | | | |
|---|---|---|---|---|
| 2007/0277971 | A1* | 12/2007 | Garcia | E21B 43/105 166/212 |
| 2011/0000664 | A1* | 1/2011 | Adam | E21B 43/105 166/207 |
| 2012/0305236 | A1* | 12/2012 | Gouthaman | E21B 41/00 166/118 |
| 2014/0216758 | A1* | 8/2014 | Jacob | E21B 34/14 166/381 |
| 2022/0081991 | A1* | 3/2022 | Deng | E21B 33/128 |

* cited by examiner

SEGMENTED EXPANSION CONE, METHOD AND SYSTEM

BACKGROUND

In the resource recovery industry and fluid sequestration industries, tubular members are sometimes expanded to larger diameters either within or outside of a borehole. Commonly such expansion is carried out using a swaging cone that is solid or segmented. Segmented cones work well for thinner material that requires only relatively small expansion pressures but are not generally used for higher expansion pressures. In higher expansion pressure situations, solid cones must be used because segmented cones undergo plastic deformations that may cause failure of the expansion but at least will cause excessive difficulty in the retrieval of the cone after expansion. Solid cones are effective but require large forces to retrieve.

SUMMARY

An embodiment of a segmented cone expansion ring including a plurality of segments each segment of the plurality of segments having opposing load walls, each load wall including one of a projection or a recess receptive of the projection, the projection having a neck portion and a rounded anchor portion and the recess having a rounded geometry and a set of dimensions complementary to the projection and that defines a clearance fit for the projection within the recess.

An embodiment of an expansion system including a housing, an expansion ring having a plurality of segments disposed about the housing, each segment of the plurality of segments having opposing load walls, each load wall including one of a projection or a recess receptive of the projection, the projection having a neck portion and a rounded anchor portion and the recess having a rounded geometry and a set of dimensions complementary to the projection and that defines a clearance fit for the projection within the recess, and a pre-cone disposed about the housing and adjacent the ring.

A method for expanding a tubular member including introducing a system as in any prior embodiment into the tubular member, landing the pre-cone at an end of the tubular member, urging the pre-cone into the tubular member, urging the ring into the tubular member, loading the load walls of the plurality of segments of the ring while not loading the projections and recesses of the plurality of segments, and expanding the tubular member.

An embodiment of a borehole system including a borehole a subsurface formation, a string disposed within the borehole, and an expansion system disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
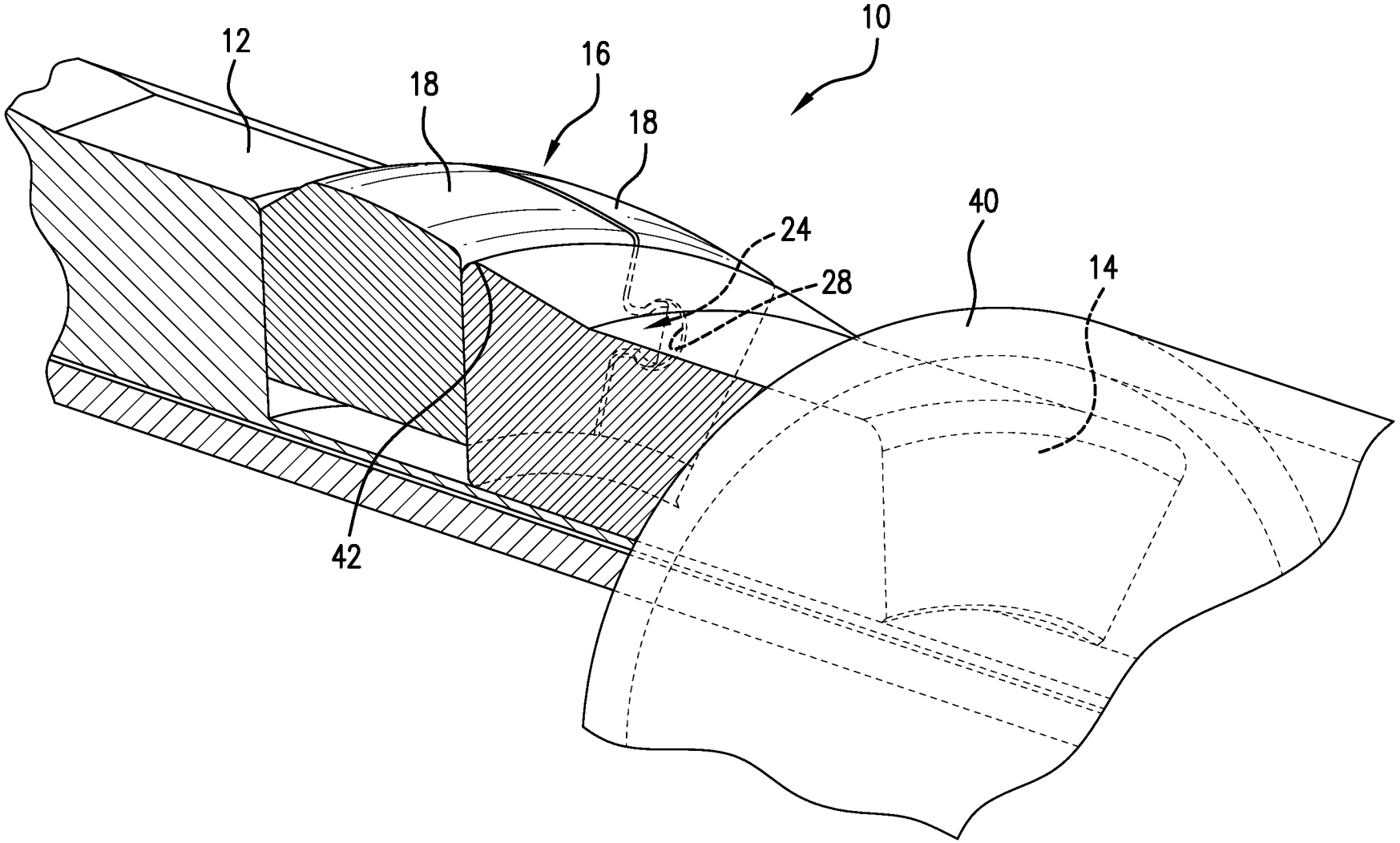
FIG. 1 is a perspective view of a high-pressure expansion system an actuated position.
Figure 2:
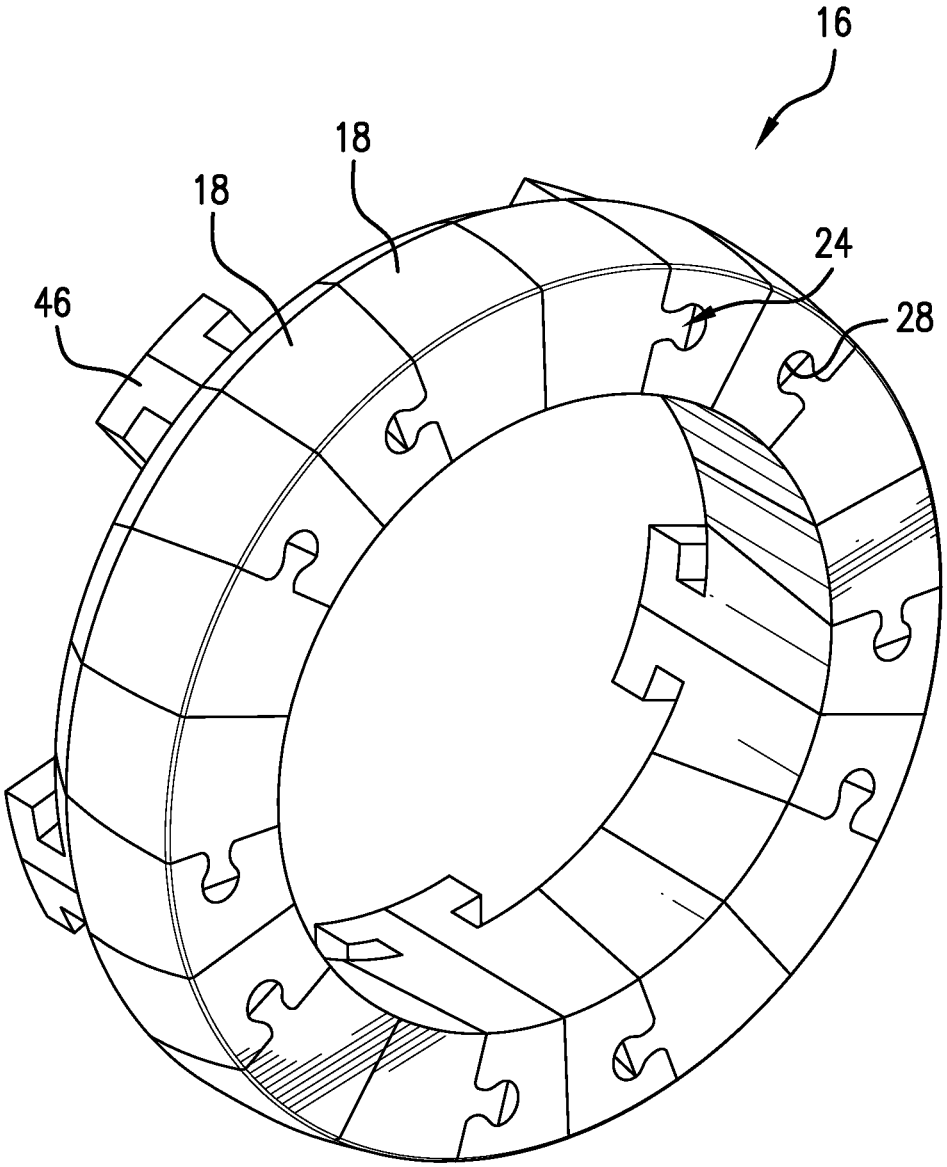
FIG. 2 is a perspective view of a segmented expansion ring in of the expansion system of FIG. 1 illustrated in an actuated position.
Figure 3:
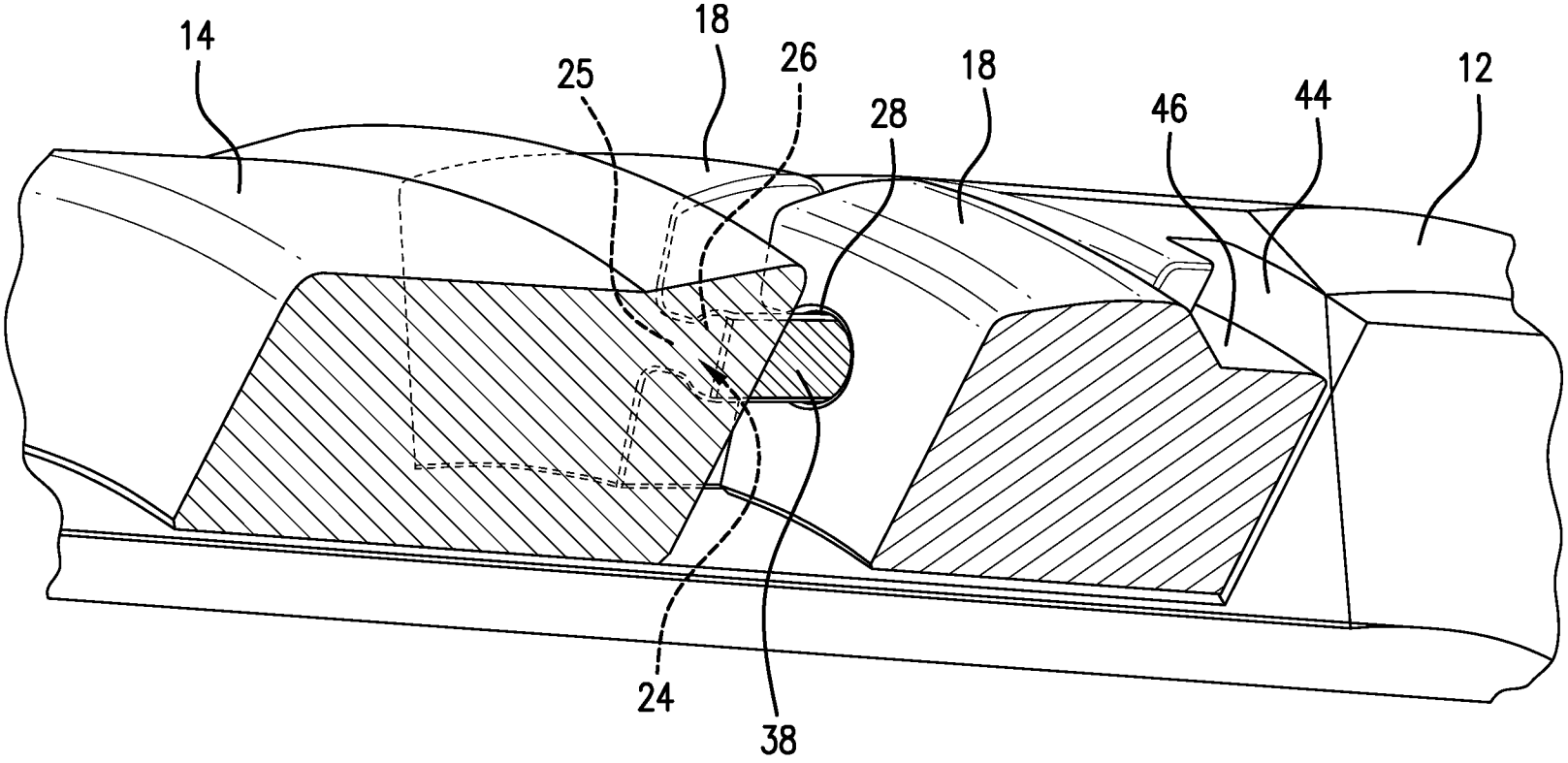
FIG. 3 is the view of FIG. 1 in a retrieval position.

Referring to FIGS. 1-3, an expansion system 10 is illustrated. System 10 includes a housing 12, a pre-cone 14 and a segmented ring 16. The ring 16 comprises a plurality of wedge shaped segments 18 that are specifically configured to be loadable along load walls 20 and 22 (see FIG. 4) thereof while not loading projections 24 (neck 25 and anchor 26) and recesses 28 thereof. The particular arrangement as described allows for expansion of tubular members at more than 10-fold of the pressure that can be achieved with segmented expansion rings of the prior art. The protection of the projections 24 and recesses 28 is accomplished by configuring the projections 24 and recesses with a clearance at all surfaces of each of these components that is greater than a degree of elastic deformation of the segments during use. Stated another way, dimensions of the projection 24 should be about 2%-about 15% less than corresponding dimensions of the recess 28. In embodiments, clearance may range from about 0.015 to a practical limit whereat the clearance would be sufficient to allow the assembled projection and recess to come apart. Since the purpose of the projection 24 and recess 28 is to prevent adjacent segments from coming apart (meaning the projection pulling out of the recess in a circumferential direction of the ring, or in other words, the anchor pulling straight through the narrowest part of the recess) after being assembled, a clearance that would allow disassembly in such a way would be beyond the scope of the disclosure. In embodiments, the range may be about 0.015 to about 1.00 inch.

Figure 4:
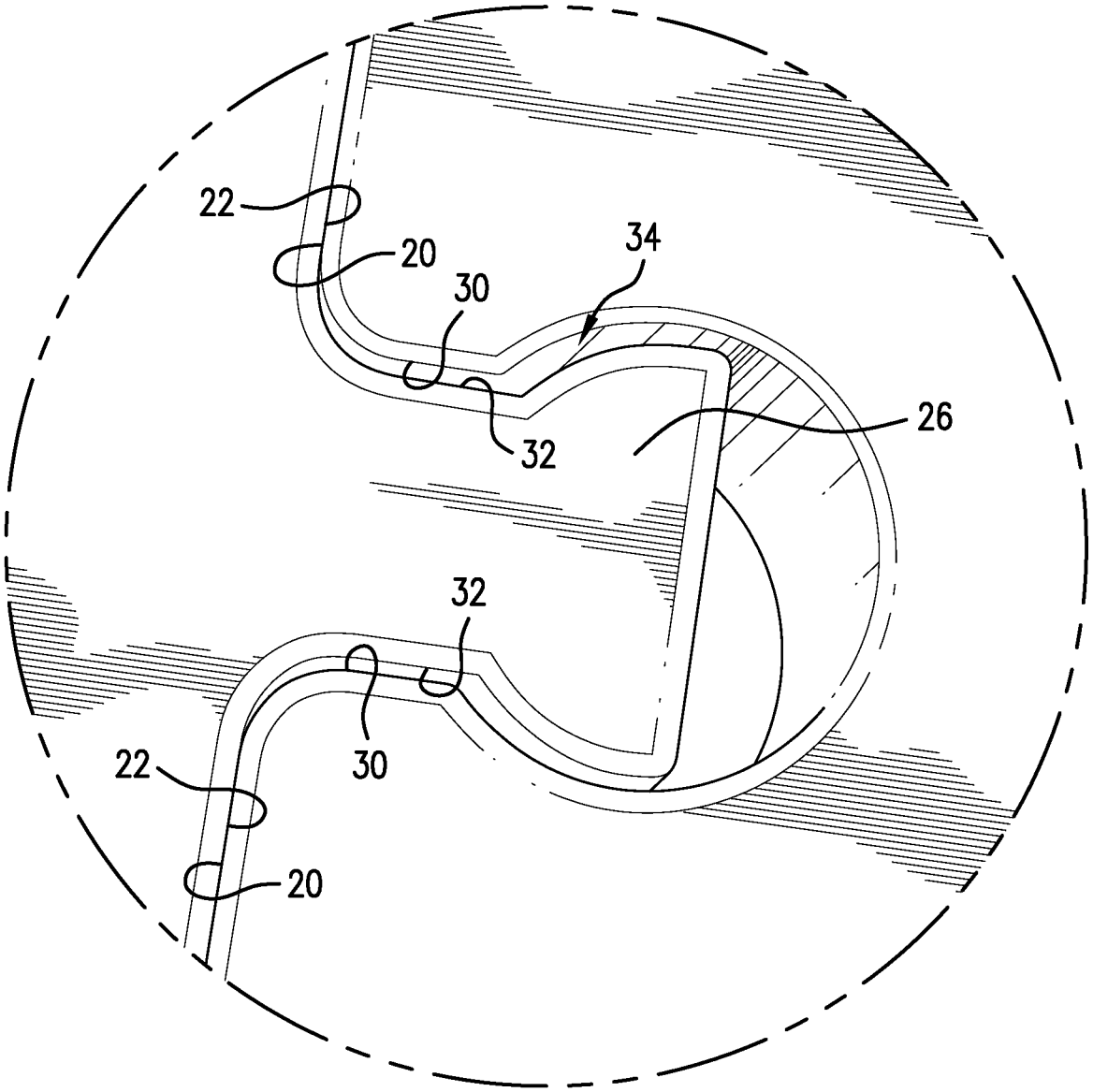
FIG. 4 is an end view of two segments of the ring of FIG. 1 illustrating the rails thereof.

Clearance as described is best viewed in FIG. 4. It will be appreciated that load walls 20 and 22 are in contact with one another yet as the load walls 20/22 of the segments transition into the projection 24 and recess 28, respectively, surfaces 30 and 32 diverge and do not make contact. A gap 34 is maintained at all areas of the surface of projection 24 and the surface of recess 28. During loading, the recess 28 may be deformed to some degree but the degree of deformation is less than the clearance represented in gap 34 such that the projection is never loaded by the surface 30 of the recess 28 during use of the expansion system 10, even at expansion pressures greater than 1,000,000 pounds such as is the case in larger and higher yield materials. It has been found by the inventor hereof that the functional attribute that forms the benefit of the disclosed structure (no loading of the projection during use) is further enhanced, in some embodiments, by the projection 24 and recess 28 having rounded geometries as shown. In addition, it has been found that the function as described is yet further enhanced, in some embodiments, by the recess 28 having a circular cross section, similar to that illustrated in FIG. 3 while the anchor 26 of the projection 24 is truncated creating surface 38, again similar to that illustrated in FIG. 3. The particular geometry illustrated in FIG. 4 maximizes the size of the anchor 26 to prevent circumferential direction disassembly while also maximizing clearance between the anchor 26 and the recess 28.

During use, and referring to FIGS. 1-4, the system 10 is run into a tubular 40 that may be a portion of a string and that requires expansion. The pre-cone 14 contacts tubular 40 first and expands it to a largest diameter portion 42 of the pre-cone 40. Continued inward driving of the system 10 into tubular 40 engages ring 16 with tubular 40 to further expand tubular 40. Motion continues until the tubular 40 is fully expanded for the distance desired. Once expansion is completed, a pull on housing 12 will act though slot 44 on a handle 46 of one or more of the plurality of segments 18. In embodiments, there will be handles 46 on every other segment 18 of the plurality of segments. Upon pulling housing 12 and transferring that pull to the segments 18 with handles 46, the system 10 still appears as is illustrated in FIG. 3. In this position the outside diameter of the ring 16 is collapsed such that retrieval is rendered much easier than it would be had the ring be of a fixed size as would be the case for high pressure expansions used only solid expansion rings in the past.

Figure 5:
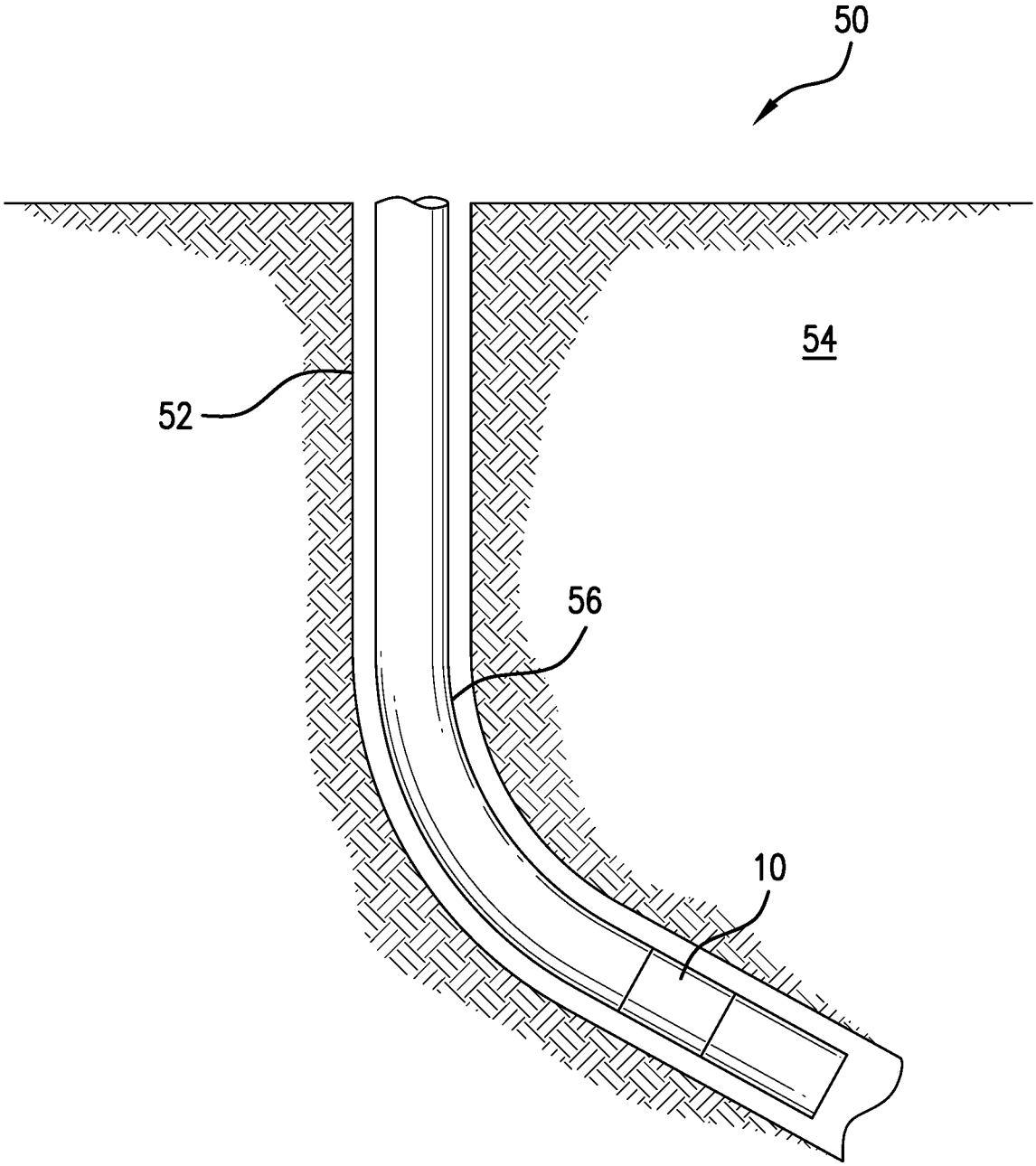
FIG. 5 is a view of a borehole system including the expansion system disclosed herein.

Referring to FIG. 5, a borehole system 50 is illustrated. System 50 comprises a borehole 52 in a subsurface formation 54. A string 56 is disposed within the borehole 52. An expansion system 10 as disclosed herein is disposed within or as a part of the string 56.

Set forth below are some embodiments of the foregoing disclosure:

Embodiment 1: A segmented cone expansion ring including a plurality of segments each segment of the plurality of segments having opposing load walls, each load wall including one of a projection or a recess receptive of the projection, the projection having a neck portion and a rounded anchor portion and the recess having a rounded geometry and a set of dimensions complementary to the projection and that defines a clearance fit for the projection within the recess.

Embodiment 2: The ring as in any prior embodiment wherein the clearance is of an amount greater than an amount of deformation experienced by the plurality of segments, during use.

Embodiment 3: The ring as in any prior embodiment wherein the clearance is obtained by formation of the dimensions of the projection from about 2% to about 15% less than corresponding dimensions of the recess.

Embodiment 4: The ring as in any prior embodiment wherein the clearance is about 0.015 inch at both the neck and the rounded anchor portions.

Embodiment 5: The ring as in any prior embodiment wherein the clearance is about 1.00 inch at both the neck and the rounded anchor portions.

Embodiment 6: The ring as in any prior embodiment wherein the projection rounded portion is truncated.

Embodiment 7: The ring as in any prior embodiment wherein the projection rounded portion defines a semicircle in cross section.

Embodiment 8: The ring as in any prior embodiment where in the ring presents a radially outer surface having a geometry that is a frustum of an ogive.

Embodiment 9: The ring as in any prior embodiment wherein the load walls of the plurality of segments are in contact with one another over the entirety of each load wall other than at projections and recesses.

Embodiment 10: An expansion system including a housing, an expansion ring having a plurality of segments disposed about the housing, each segment of the plurality of segments having opposing load walls, each load wall including one of a projection or a recess receptive of the projection, the projection having a neck portion and a rounded anchor portion and the recess having a rounded geometry and a set of dimensions complementary to the projection and that defines a clearance fit for the projection within the recess, and a pre-cone disposed about the housing and adjacent the ring.

Embodiment 11: The system as in any prior embodiment wherein the pre-cone includes an outer surface that smoothly transitions to a radially outer surface of the expansion ring.

Embodiment 12: The system as in any prior embodiment wherein a segment of the plurality of segments includes a pull tab.

Embodiment 13: The system as in any prior embodiment wherein a plurality of segments of the plurality of segments includes a pull tab.

Embodiment 14: The system as claimed in claim 13 wherein every other segment of the plurality of segments includes a pull tab.

Embodiment 15: The system as in any prior embodiment wherein the pull tab is a T tab.

Embodiment 16: The system as in any prior embodiment wherein the housing includes a receptacle for a pull tab connected to each of one or more segments of the plurality of segments.

Embodiment 17: A method for expanding a tubular member including introducing a system as in any prior embodiment into the tubular member, landing the pre-cone at an end of the tubular member, urging the pre-cone into the tubular member, urging the ring into the tubular member, loading the load walls of the plurality of segments of the ring while not loading the projections and recesses of the plurality of segments, and expanding the tubular member.

Embodiment 18: The method as in any prior embodiment further including pulling on the housing, pulling on segments having pull tabs with the housing, collapsing the ring, and retrieving the ring from the tubular member.

Embodiment 19: A borehole system including a borehole in a subsurface formation, a string disposed within the borehole, and an expansion system as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A segmented cone expansion ring comprising:

a plurality of segments each segment of the plurality of segments having opposing load walls;

each load wall including one of a projection or a recess receptive of the projection, the projection having a neck portion and a truncated rounded anchor portion and the recess having a rounded geometry and a set of dimensions complementary to the projection and that defines a clearance fit for the projection within the recess.

2. The ring as claimed in claim 1 wherein the clearance is of an amount greater than an amount of deformation experienced by the plurality of segments, during use.

3. The ring as claimed in claim 1 wherein the clearance is obtained by formation of the dimensions of the projection from about 2% to about 15% less than corresponding dimensions of the recess.

4. The ring as claimed in claim 1 wherein the clearance is about 0.015 inch at both the neck and the rounded anchor portions.

5. The ring as claimed in claim 1 wherein the clearance is about 1.00 inch at both the neck and the rounded anchor portions.

6. The ring as claimed in claim 1 wherein the projection rounded portion defines a semicircle in cross section.

7. The ring as claimed in claim 1 where in the ring presents a radially outer surface having a geometry that is a frustum of an ogive.

8. A method for expanding a tubular member comprising:

introducing a system as claimed in claim 7 into the tubular member;

landing the pre-cone at an end of the tubular member, urging the pre-cone into the tubular member;

urging the ring into the tubular member;

loading the load walls of the plurality of segments of the ring while not loading the projections and recesses of the plurality of segments; and expanding the tubular member.

9. The method as claimed in claim 8 further including:

pulling on the housing;

pulling on segments having pull tabs with the housing;

collapsing the ring; and retrieving the ring from the tubular member.

10. The ring as claimed in claim 1 wherein the load walls of the plurality of segments are in contact with one another over the entirety of each load wall other than at projections and recesses.

11. An expansion system comprising:

a housing;

an expansion ring having a plurality of segments disposed about the housing, each segment of the plurality of segments having opposing load walls;

each load wall including one of a projection or a recess receptive of the projection, the projection having a neck portion and a truncated rounded anchor portion and the recess having a rounded geometry and a set of dimensions complementary to the projection and that defines a clearance fit for the projection within the recess; and a pre-cone disposed about the housing and adjacent the ring.

12. The system as claimed in claim 11 wherein the pre-cone includes an outer surface that smoothly transitions to a radially outer surface of the expansion ring.

13. The system as claimed in claim 11 wherein a segment of the plurality of segments includes a pull tab.

14. The system as claimed in claim 11 wherein a plurality of segments of the plurality of segments includes a pull tab.

15. The system as claimed in claim 14 wherein every other segment of the plurality of segments includes a pull tab.

16. The system as claimed in claim 15 wherein the pull tab is a T tab.

17. The system as claimed in claim 11 wherein the housing includes a receptacle for a pull tab connected to each of one or more segments of the plurality of segments.

18. A borehole system comprising:

a borehole in a subsurface formation;

a string disposed within the borehole; and an expansion system as claimed in claim 10 disposed within or as a part of the string.

* * * * *